US006928924B2

(12) United States Patent
Miyauchi et al.

(10) Patent No.: US 6,928,924 B2
(45) Date of Patent: Aug. 16, 2005

(54) SPRAY-TYPE DAMPENING WATER SUPPLY APPARATUS

(75) Inventors: Chuji Miyauchi, Tokyo (JP); Kazuo Aihara, Kanagawa-ken (JP); Tamotsu Itakura, Hyogo-ken (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 141 days.

(21) Appl. No.: 10/326,115

(22) Filed: Dec. 23, 2002

(65) Prior Publication Data

US 2003/0209613 A1 Nov. 13, 2003

(30) Foreign Application Priority Data

May 10, 2002 (JP) ..... 2002-135934

(51) Int. Cl.[7] ..... B41F 7/30
(52) U.S. Cl. ..... 101/147; 239/518; 239/550
(58) Field of Search ..... 101/147, 148; 239/518, 520, 521, 522, 550, 556, 284.1, 284.2

(56) References Cited

U.S. PATENT DOCUMENTS 3,924,531 A * 12/1975 Klingler ..... 101/147
5,299,495 A * 4/1994 Schoeps et al. ..... 101/147
5,905,515 A * 5/1999 Yoshimura ..... 347/45
6,494,387 B1 * 12/2002 Kaneko ..... 239/296

FOREIGN PATENT DOCUMENTS

DE 19937135 * 6/2000
JP 2602799 11/1999

OTHER PUBLICATIONS

Newspaper Printing Manual, pp. 75–76, published Apr. 10, 1997 by Japan Newspaper Association.

* cited by examiner

*Primary Examiner*—Stephen R. Funk
(74) *Attorney, Agent, or Firm*—Foley & Lardner LLP

(57) ABSTRACT

A spray-type dampening water supply apparatus having a spray whose nozzles are protected against adhesion of any foreign matter to the nozzle surfaces and in which at least orifices of the nozzles can be easily cleaned out. Each nozzle of the spray has a guide surface slanting from an upstream outer peripheral edge toward a downstream central orifice. A partition of the spray is disposed downstream of the nozzle assembly and has a plurality of apertures confronting the respective nozzles. The spray is equipped with means for opening and closing the apertures of the partition.

9 Claims, 12 Drawing Sheets

Prior Art 1

SPRAY-TYPE DAMPENING WATER SUPPLY APPARATUS

BACKGROUND OF THE INVENTION

1. Field of the Invention

The present invention relates to a spray-type dampening water supply apparatus for an offset printing press, and more particularly to a spray-type dampening water supply apparatus having nozzles that can be prevented from being contaminated with dirt at a portion surrounding and adjacent to the orifice of each nozzle.

2. Description of the Background

In offset printing, printing is carried out using a printing plate having a uniform surface formed of image regions that are lipophilic and non-image regions that are hydrophilic. First, dampening water and oil-based ink are supplied to the plate surface so that the ink adheres to only the image regions by the interactive repulsion between the water and oil. Then, this inked image is printed on paper via a blanket.

In offset printing presses, it is known to use a spray-type dampening water supply apparatus that supplies dampening water to the peripheral surface of a roller extending to the printing plate, from nozzles. The orifice of each nozzle has a very small oval hole in order to provide very fine water drops and adjust the spraying with precision. A filter is located in a pipe through which the dampening water is fed from a reservoir to the nozzles, to block small-size foreign matter. This conventional technology is exemplified by NEWSPAPER PRINTING MANUAL published Apr. 10, 1997 by the Japan Newspaper Association, pages 75–76 (hereinafter called Prior Art 1) and Japanese Utility Model Registration Gazette No. 2602799 (hereinafter called Prior Art 2).

In many spray-type dampening water supply apparatuses of the type according to Prior Art 1, spray nozzles Q10 of a shape shown in FIG. 13 of the accompanying drawings are used. Each nozzle Q10 has a single, generally C-shaped groove Q17 engraved in the end surface Q16, and a nozzle tip Q12 having an orifice Q13 projecting centrally from the groove bottom Q18 toward the nozzle end surface Q16, and terminating short of this nozzle end surface Q16. Prior Art 1 shows swirl QH.

In Prior Art 2, as shown in FIG. 14, a pipe, which dampening water is made to flow through from a dampening water reservoir B1 toward a spray unit Q201 under pressure, has a first valve V1 located upstream of the spray unit Q201 for opening and closing the pipe and a second valve V2 for opening the pipe to the outside in order to suck in air. In a pipe leading to the reservoir B1 to be connected downstream of the nozzle Q20, a pipe leading to a decompression container B2, and a pipe leading to a compression container B3, there are respectively located a sixth valve V1*a* for opening and closing the pipe with respect to the reservoir B1, the second valve V2 for opening and closing the pipe with respect to the decompression container B2 decompressed to a pressure below atmospheric pressure by a decompression pump U2, and a third valve V3 containing cleaning liquid M and compressed to a pressure above atmospheric pressure by a compression pump U3. Note that in Prior Art 2, a filter QF is present.

In Prior Art 2, to remove foreign matter jammed in the orifice Q23, an electromagnetic valve V5 in the spray unit Q201 is closed to stop spraying of dampening water and, in the meantime, the first valve V1 and the sixth valve V1*a* disposed upstream and downstream, respectively, of the spray unit Q201 are closed. Then, when the second valve V2 is opened to communicate the associated pipe with the decompression container B2, the pressure in the same pipe is decreased, and when the electromagnetic valve V5 is opened the associated pipe is communicated to outside (atmosphere) to suck in air from the orifice Q23. As a result, any foreign matter jammed in the orifice Q23, together with the residual dampening water in the vicinity of the orifice Q23 and in the pipe, is urged to be introduced into the pipe. Subsequently, when the fourth valve V4 is opened, the residual liquid containing foreign matter in the pipe is sucked into the decompression container B2. This procedure is repeated several times in an effort to remove the foreign matter jammed in the orifice Q23.

If this removing of the foreign matter jammed in the orifice Q23 is unsuccessful, the first valve V1 and the sixth valve V1*a* disposed upstream and downstream, respectively, of the spray unit Q201 are closed and, at the same time, a breaker plate Q271 is moved toward and short of the orifice Q23. Then, when the third valve V3 is opened to communicate the associated pipe to the compression container B3, the cleaning liquid M to be supplied to the nozzle Q20 from the compression container B3 is sprayed so that the foreign matter jammed in the orifice Q23 is released from the orifice Q23. At the same time, the cleaning liquid M sprayed to the breaker plate Q271 is dispersed to clean away the dirt adhered to the circumference of the nozzle Q20.

However, Prior Art 1 and Prior Art 2 encountered the following problems. With the nozzle according to Prior Art 1 disclosed in the NEWSPAPER PRINTING MANUAL, dampening water is sprayed from the generally C-shaped groove engraved in the nozzle end surface. Generally, in circulating spouted fluid, which is different in velocity from the surrounding fluid, pressure is lowered so as to draw in the surrounding fluid due to the velocity difference. Accordingly, around spouted fluid, on every occasion dampening water is sprayed, an atmosphere contaminated with ink mist, paper powder, etc. strikes the nozzle tip and the neighboring portion as a complicated eddy flow, thereby instantly making their surfaces dirty and causing standing water as residual dampening water around the nozzle tip. After termination of printing, the spraying status would be deteriorated due to the dirt deposited as the standing residual water vapor. Consequently, to obtain an optimized amount of spray of dampening water, these prior art technologies require meticulous adjustments in spray amount of dampening water and also periodical maintenance and cleaning, which are laborious and time-consuming.

According to Prior art 2 disclosed in Japanese Utility Model Registration Gazette No. 2602799, in an adjusted dampening water supply spray-type apparatus, a filter in the pipe blocks foreign matter in an attempt to prevent the orifice from becoming clogged with foreign matter. Instead, dampening water mist, ink mist and paper powder float in the damping-water spraying space. The residual dampening water containing these substances is mixed into the standing liquid adhered around the nozzle and vapor to cause deposited foreign matter after termination of printing, so that the orifice tends to become clogged with dirt as the deposited foreign matter.

Further, during cleaning of the nozzle, the above-mentioned foreign matter would enter the nozzle from the orifice to clog the orifice or enter the oval hole of the nozzle end surface to be caught inside the orifice at its small-diameter side during subsequent spraying. To cope with this clogging, reduction of the pressure in the pipe could be considered to suck the foreign matter from the orifice. However, because of the smallness of the orifice, only an inadequate sucking force can be expected.

In addition, the foreign matter adhered around the nozzle tends to be attracted into the orifice to increase clogging of the orifice, but the foregoing prior art technologies could not solve this problem.

As described above, a cleaning liquid is sprayed toward the breaker plate, which is disposed immediately upstream of the orifice, from the compression container in an attempt to wash away foreign matter that has entered and clogged the orifice and also wash around the circumference of the nozzle with the cleaning liquid reflected on the breaker plate. However, partly because the pressure of the compressed cleaning liquid is lowered due to the smallness of the orifice diameter, the washing power would be attenuated to such a level that the foreign matter could only be incompletely removed.

Further, much of the sprayed cleaning liquid is scattered along the surface of the breaker plate rather than reflecting on the breaker plate, so that an adequate degree of spraying power with respect to the nozzle confronting the breaker plate could not be guaranteed. Furthermore, because after termination of this cleaning, residual water occurs around the nozzle and then vaporizes to cause deposited dirt, an intended cleaning effect cannot be expected.

For removing foreign matter jammed in and dirt adhered around the orifice, it requires a decompression container, a compression container, a breaker plate and a control unit for controlling these parts, so that the whole apparatus is large in size and expensive.

SUMMARY OF THE INVENTION

With the foregoing problems in view, it is an object of the present invention to provide a compact spray-type dampening water supply apparatus having nozzles that are free of adhesion of any foreign matter to the nozzle surfaces and can be easily clean out.

To attain the above object, according to a first aspect of the present invention, there is provided a spray-type dampening water supply apparatus having a nozzle for spraying dampening water to a peripheral surface of a roller extending to a printing plate of an offset printing press, wherein the nozzle has a guide surface slanting from an upstream outer peripheral edge towards a downstream central orifice, and the nozzle has a groove of a generally U-shaped cross section, the guide surface being defined by an inside wall surface of the groove.

According to a second aspect of the present invention there is provided a spray-type dampening water supply apparatus having a nozzle for spraying dampening water to a peripheral surface of a roller extending to a printing plate of an offset printing press, wherein the nozzle has a guide surface slanting from an upstream outer peripheral edge toward a downstream central orifice, wherein the guide surface is conical.

According to a third aspect of the present invention there is provided a spray-type dampening water supply apparatus having a nozzle for spraying dampening water to a peripheral surface of a roller extending to a printing plate of an offset printing press, wherein the nozzle has a guide surface slanting from an upstream outer peripheral edge toward a downstream central orifice, wherein the guide surface is pyramidal.

According to a fourth aspect of the present invention there is provided a spray-type dampening water supply apparatus having a nozzle for spraying dampening water to a peripheral surface of a roller extending to a printing plate of an offset printing press, wherein the nozzle has a guide surface slanting from an upstream outer peripheral edge toward a downstream central orifice, wherein the guide surface has a through-hole extending from the outer peripheral edge toward the orifice and the guide surface is defined by an inside wall surface of the through-hole.

As a preferred feature, the guide surface has a varying tilt gradually changing from the outer peripheral edge toward the orifice.

As another preferred feature, the guide surface is composed of a plurality of segmental guide surfaces arranged equidistantly about the orifice.

According to fifth aspect of the present invention, there is provided a spray-type apparatus for supplying dampening water to a peripheral surface of a roller extending to a printing plate of an offset printing press, comprising:

a nozzle assembly of a plurality of nozzles for spraying the dampening water, each of the nozzles having a guide surface slanting from an upstream outer peripheral edge toward a downstream central orifice; and a partition disposed downstream of the nozzle assembly and having a plurality of apertures confronting the respective nozzles.

According to a sixth aspect of the present invention, there is provided a spray-type apparatus for supplying dampening water to a peripheral surface of a roller extending to a printing plate of an offset printing press, comprising:

a nozzle assembly of a plurality of nozzles for spraying the dampening water, each of the nozzles having a guide surface slanting from an upstream outer peripheral edge toward a downstream central orifice;

a partition disposed downstream of the nozzle assembly and having a plurality of apertures confronting the respective nozzles; and means for opening and closing the apertures of the partition.

As a preferred feature, each nozzle is treated at at least a portion surrounding and adjacent to the orifice so as to be prevented from adhesion of any foreign matter to the nozzle portion.

DETAILED DESCRIPTION OF THE PREFERRED EMBODIMENTS

Figure 1:
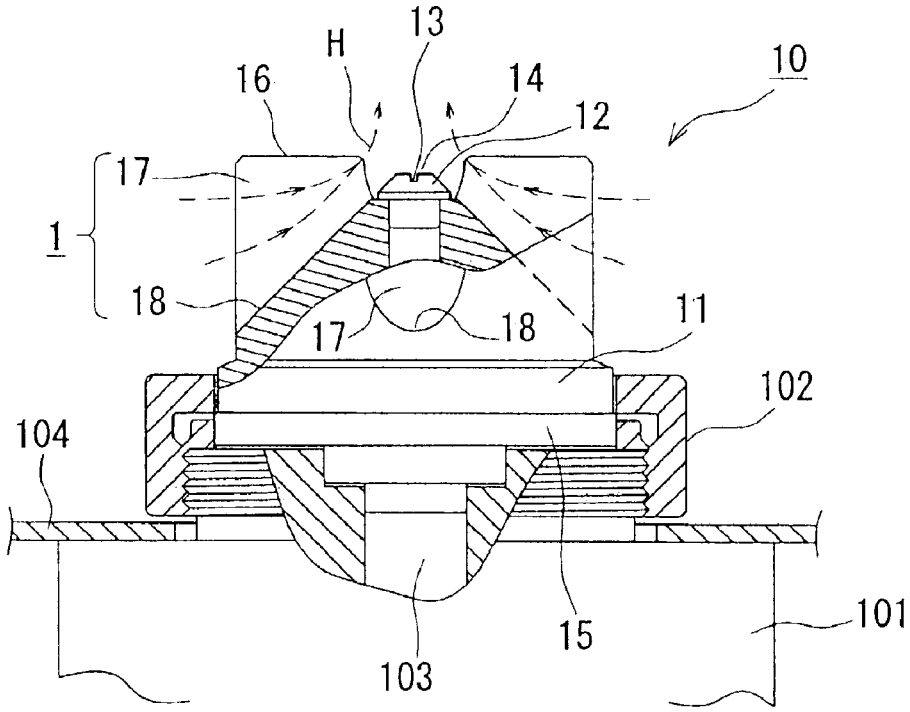
FIG. 1 is a partially cross-sectional view of a nozzle of a spray-type dampening water supply apparatus according to a first embodiment of the present invention, the nozzle having a guide surface defined by four slanting grooves.
Figure 2:
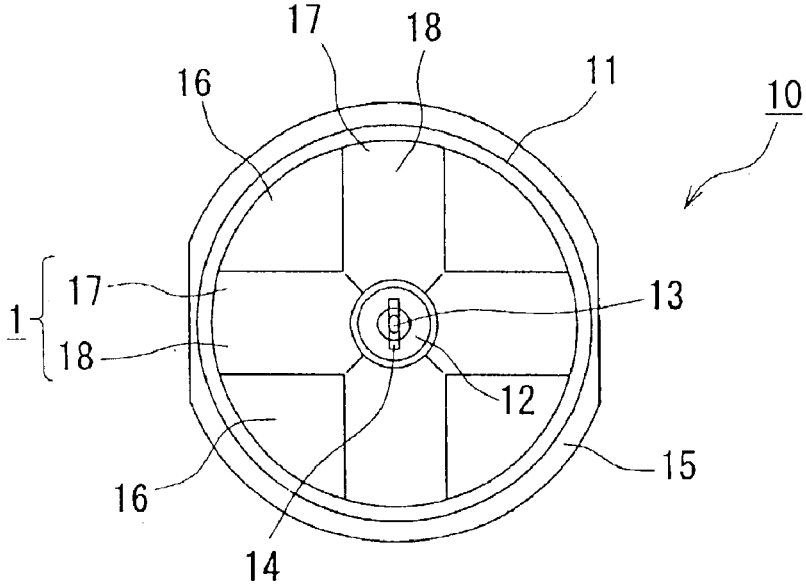
FIG. 2 is a plan view of the nozzle of FIG. 1.
Figure 3:
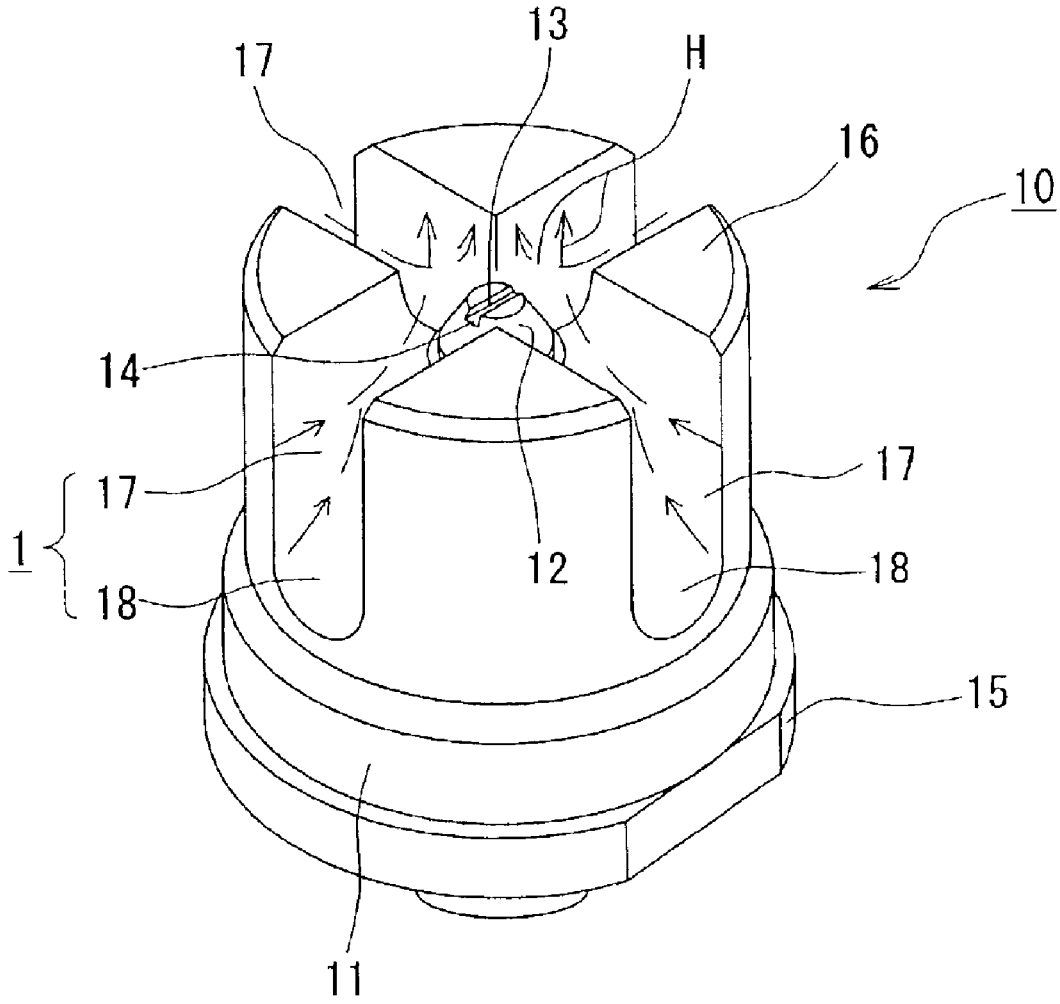
FIG. 3 is a perspective view of the nozzle of FIG. 2.
Figure 4:
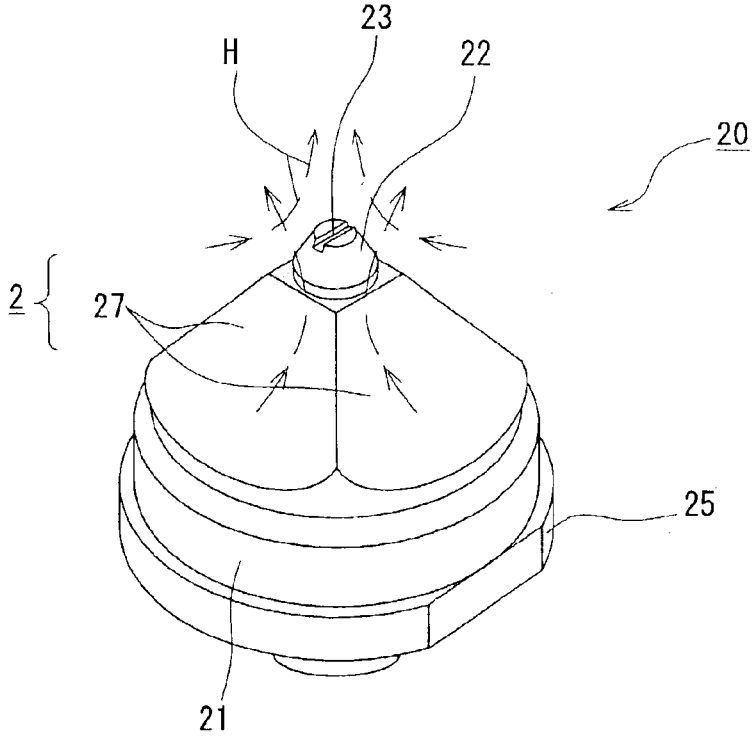
FIG. 4 is a perspective view of a nozzle according to a second embodiment of the present invention, the nozzle having a guide surface composed of four segmental guide surfaces.
Figure 5:
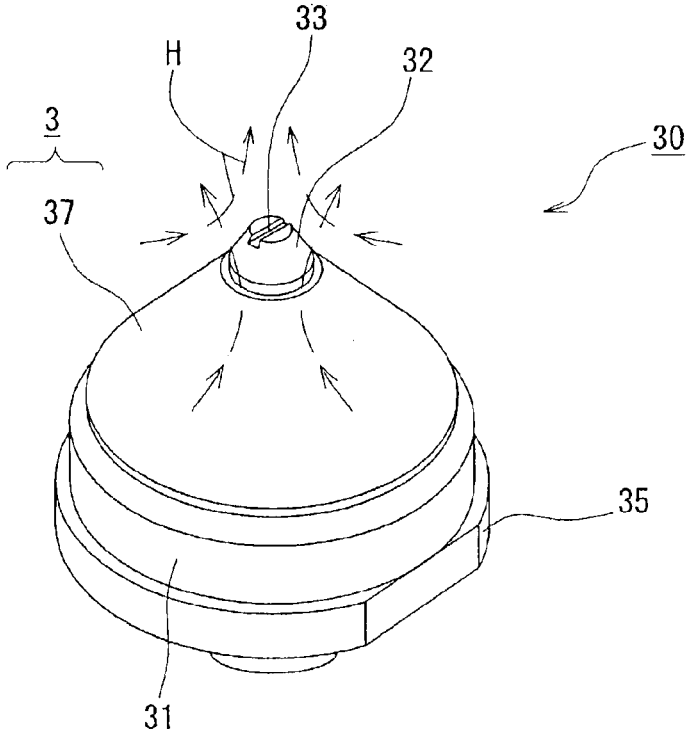
FIG. 5 is a perspective view of a nozzle according to a third embodiment of the present invention, the nozzle having a conical guide.
Figure 6:
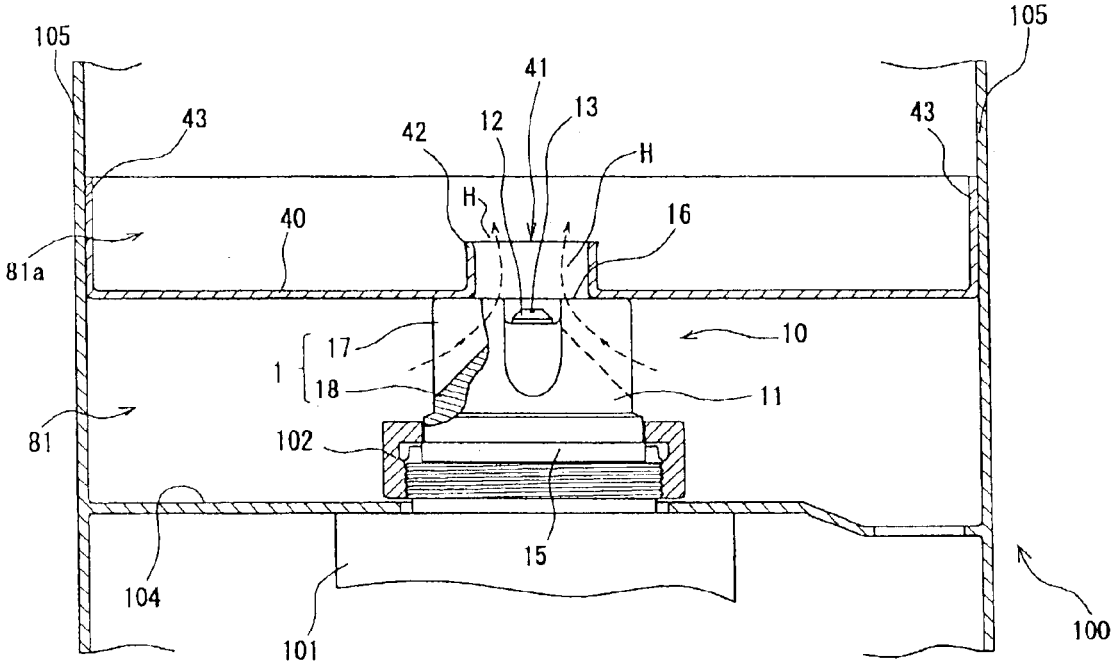
FIG. 6 is a partially cross-sectional view of a spray unit provided with a partition and a nozzle according to a fourth embodiment of the present invention, the nozzle having the guide surface of FIG. 3 being defined by a slanting groove.
Figure 7:
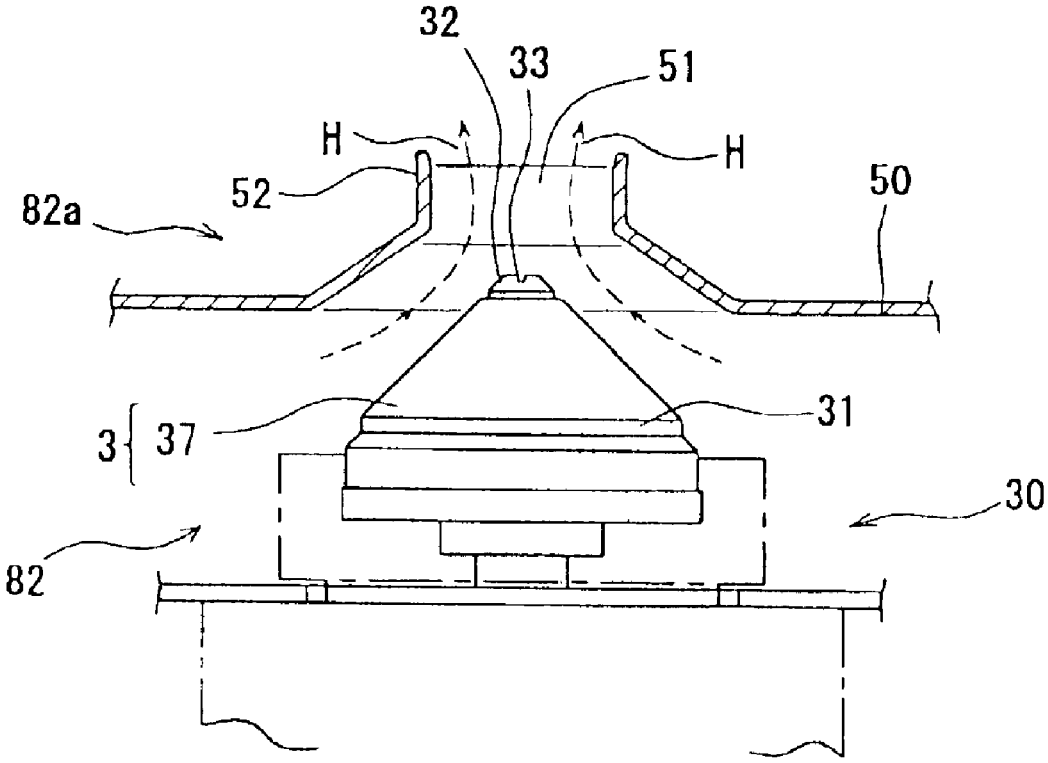
FIG. 7 is a partially cross-sectional view of a spray unit provided with a partition and a nozzle according to a fifth embodiment of the present invention, the nozzle having the guide surface of FIG. 5.
Figure 8:
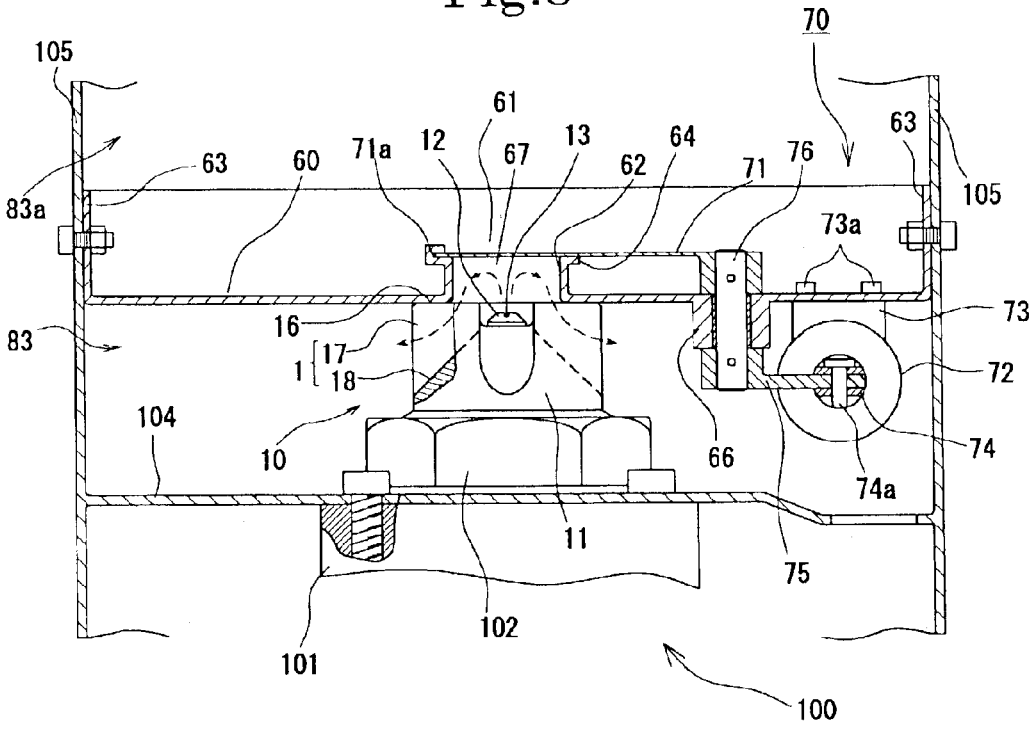
FIG. 8 is a partially cross-sectional view of a spray unit provided with a partition-and a nozzle according to a sixth embodiment of the present invention, the nozzle having a guide surface defined by four sloping grooves.
Figure 9:
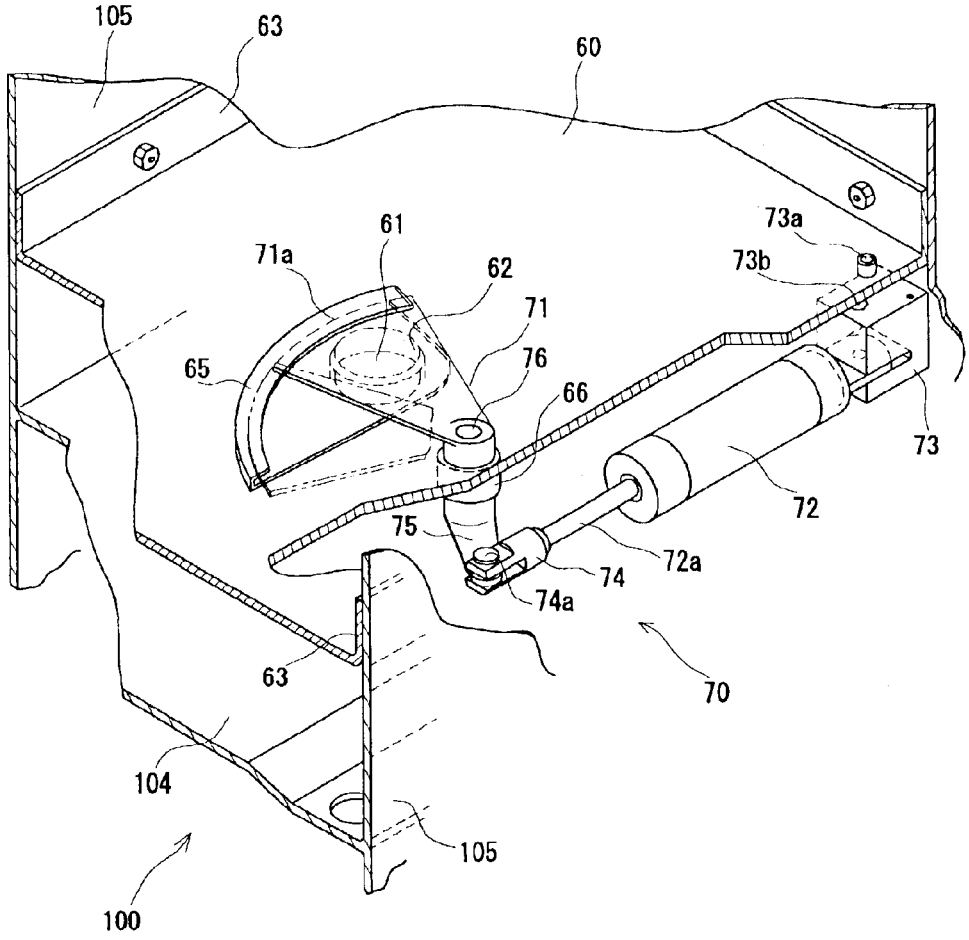
FIG. 9 is a perspective view, with parts broken away, of the partition of FIG. 8 having an opening and closing unit.
Figure 10:
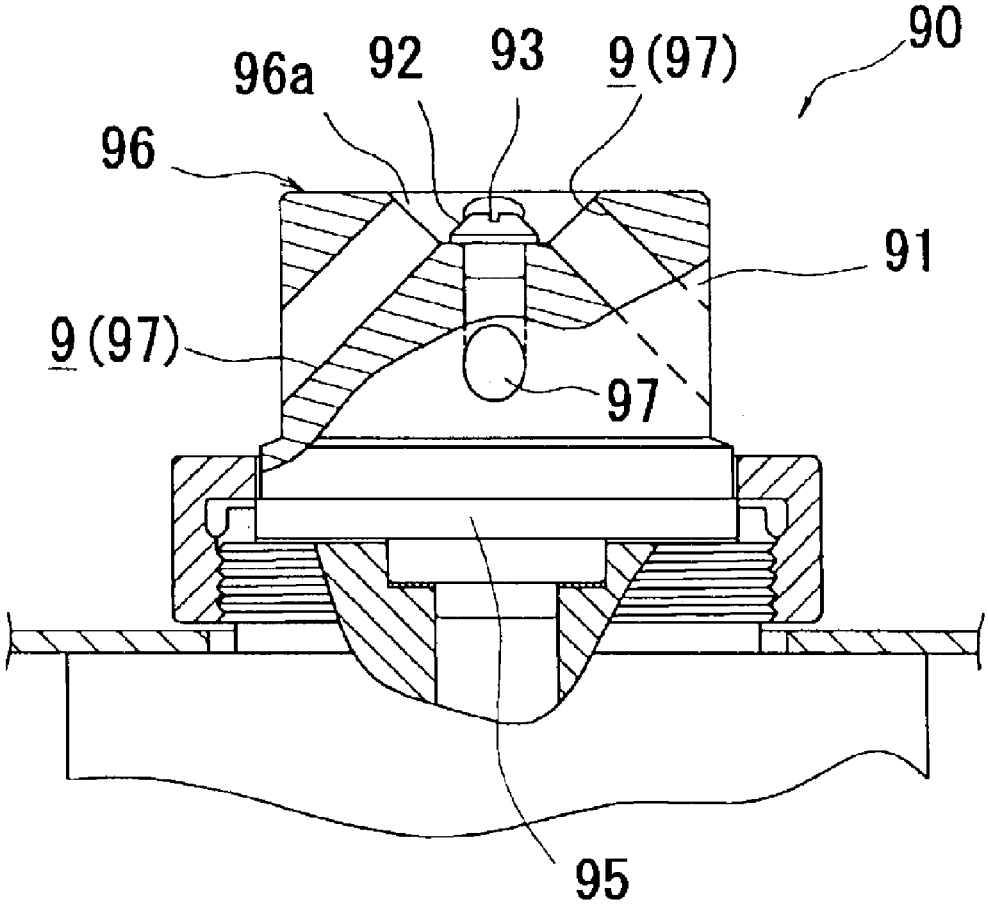
FIG. 10 is a partially cross-sectional view of a nozzle according to a seventh embodiment of the present invention, the nozzle having a guide surface defined by four slanted through holes.
Figure 11:
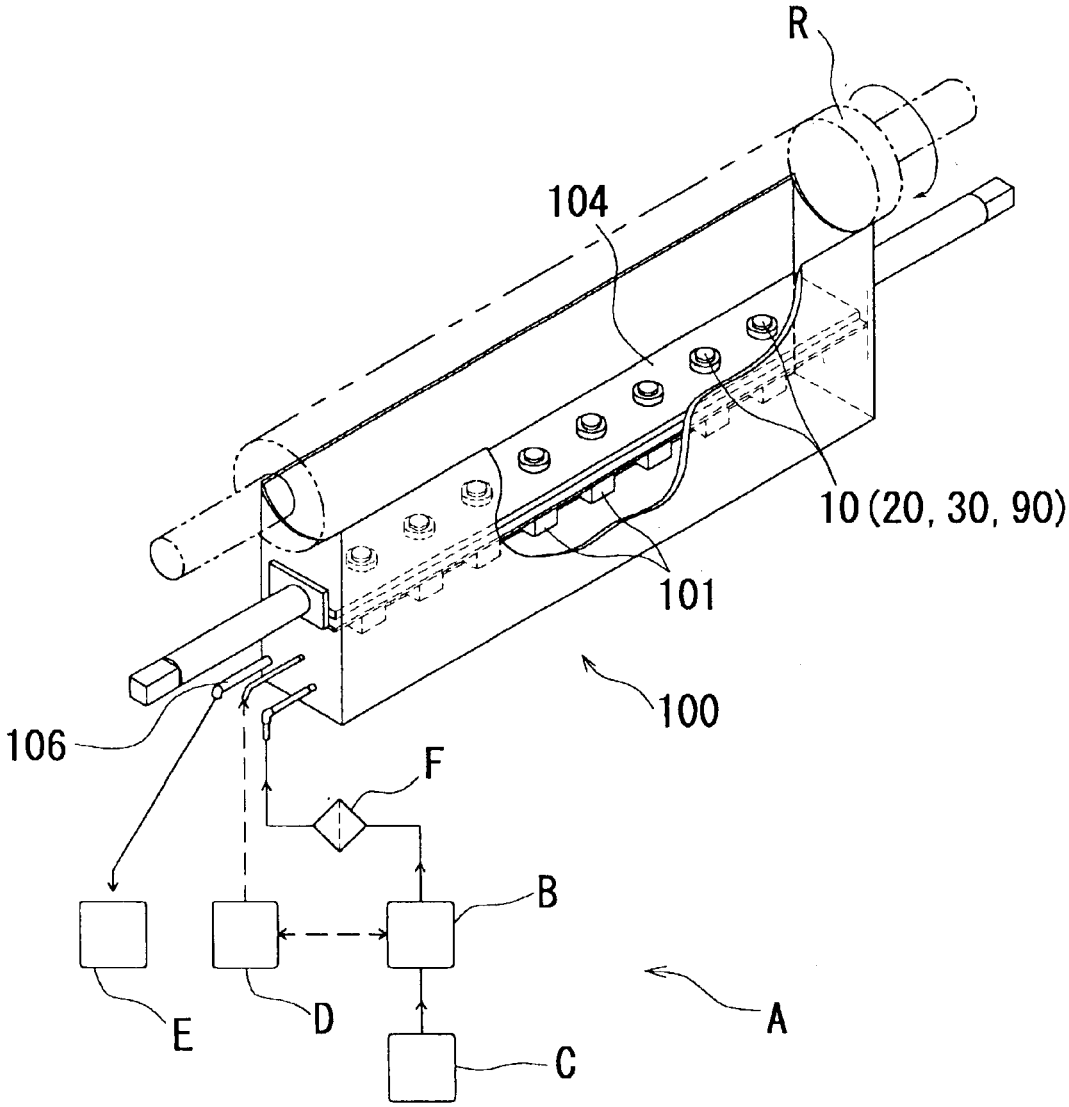
FIG. 11 is a schematic view of a dampening water supply apparatus equipped with a spray unit having the nozzles according to the foregoing embodiments of the present invention.

Various preferred embodiments of the present invention will now be described with reference to FIGS. 1 through 12 of the accompanying drawings, in which: FIG. 1 is a partially cross-sectional view of a spray-type dampening water supply apparatus having a nozzle according to a first embodiment of the present invention, the nozzle having a guide surface defined by four slanted grooves; FIG. 2 is a plan view of the nozzle of FIG. 1; FIG. 3 is a perspective view of the nozzle of FIG. 2; FIG. 4 is a perspective view of a nozzle according to a second embodiment of the present invention, the nozzle having a guide surface composed of four segmental guide surfaces; FIG. 5 is a perspective view of a nozzle according to a third embodiment of the present invention, the nozzle having a conical guide; FIG. 6 is a partially cross-sectional view of a spray unit provided with a partition and a nozzle according to a fourth embodiment of the present invention, the nozzle having the guide surface of FIG. 3 being defined by a slanting groove; FIG. 7 is a partially cross-sectional view of a spray unit provided with a partition and a nozzle according to a fifth embodiment of the present invention, the nozzle having the conical guide surface of FIG. 5; FIG. 8 is a partially cross-sectional view of a spray unit provided with a partition and a nozzle according to a sixth embodiment of the present invention, the nozzle having a guide surface defined by four sloping grooves; FIG. 9 is a perspective view of the partition of FIG. 8 having an opening and closing unit; FIG. 10 is a partially cross-sectional view of a nozzle according to a seventh embodiment of the present invention, the nozzle having a guide surface defined by four slanted through holes; FIG. 11 is a schematic view of a dampening water supply apparatus equipped with a spray unit having the nozzles according to the foregoing embodiments of the present invention; and FIG. 12 is a schematic front view of a printer, illustrating the spray unit of the spray-type dampening water supply apparatus according to the present invention.

Figure 12:
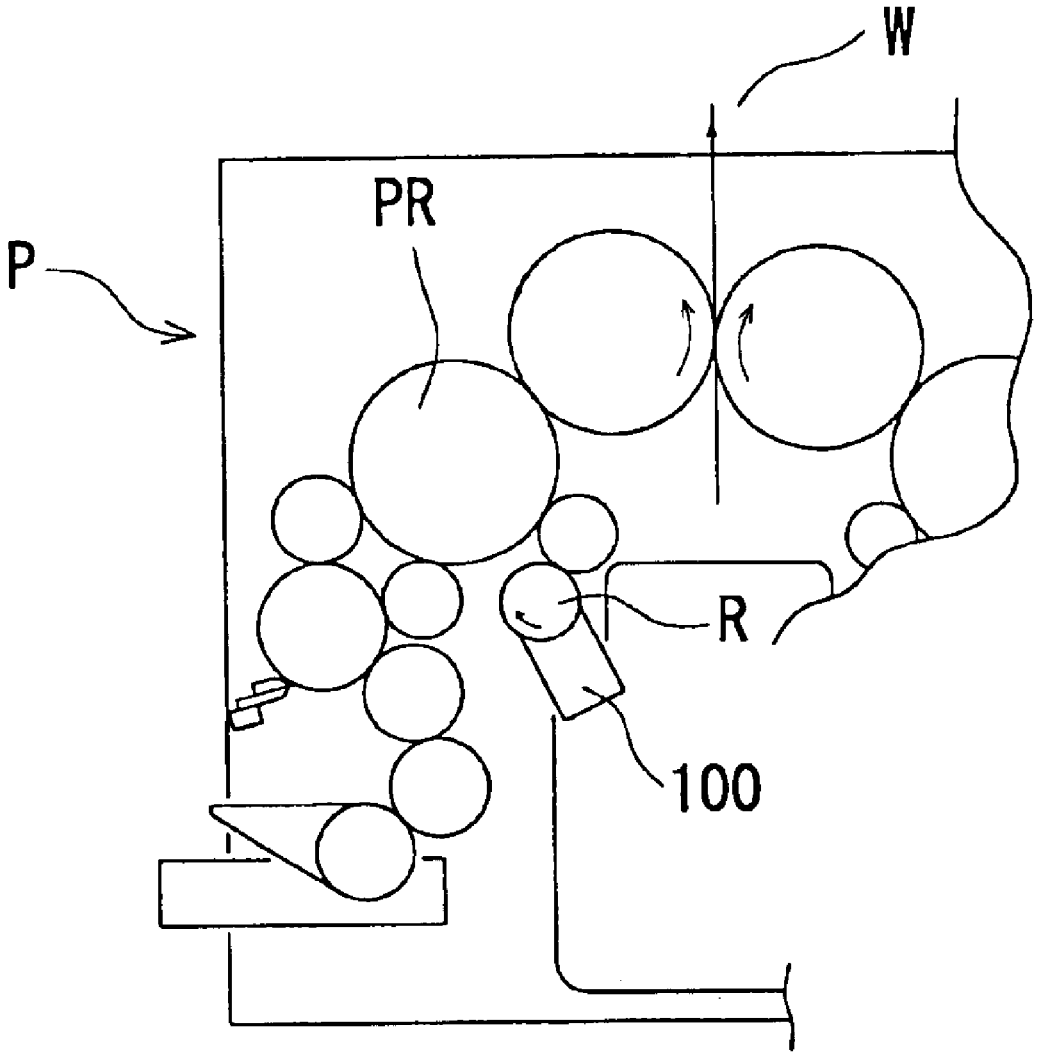
FIG. 12 is a schematic front view of a printer, illustrating the spray unit of the spray-type dampening water supply apparatus according to the present invention.
Figure 13:
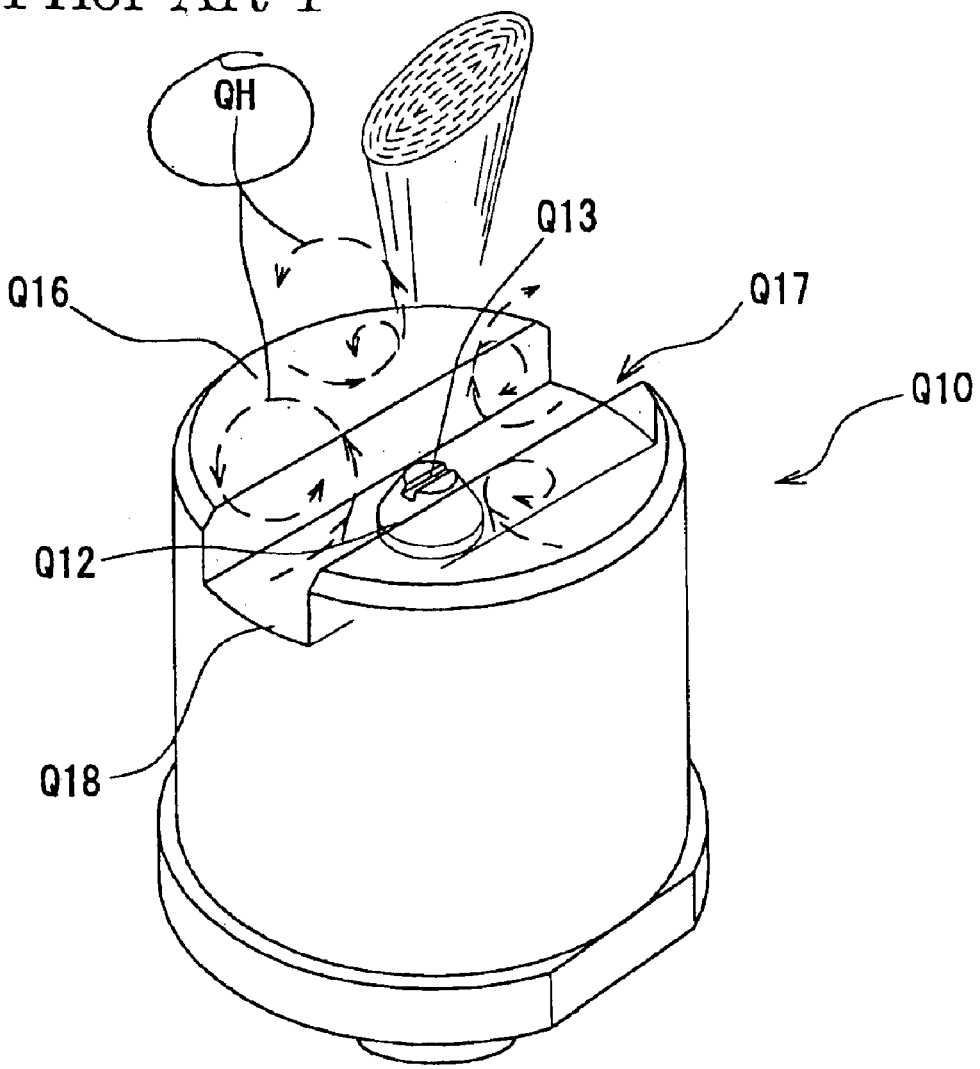
FIG. 13 is a perspective view of a nozzle of a spray-type dampening water supply apparatus according to the conventional art.
Figure 14:
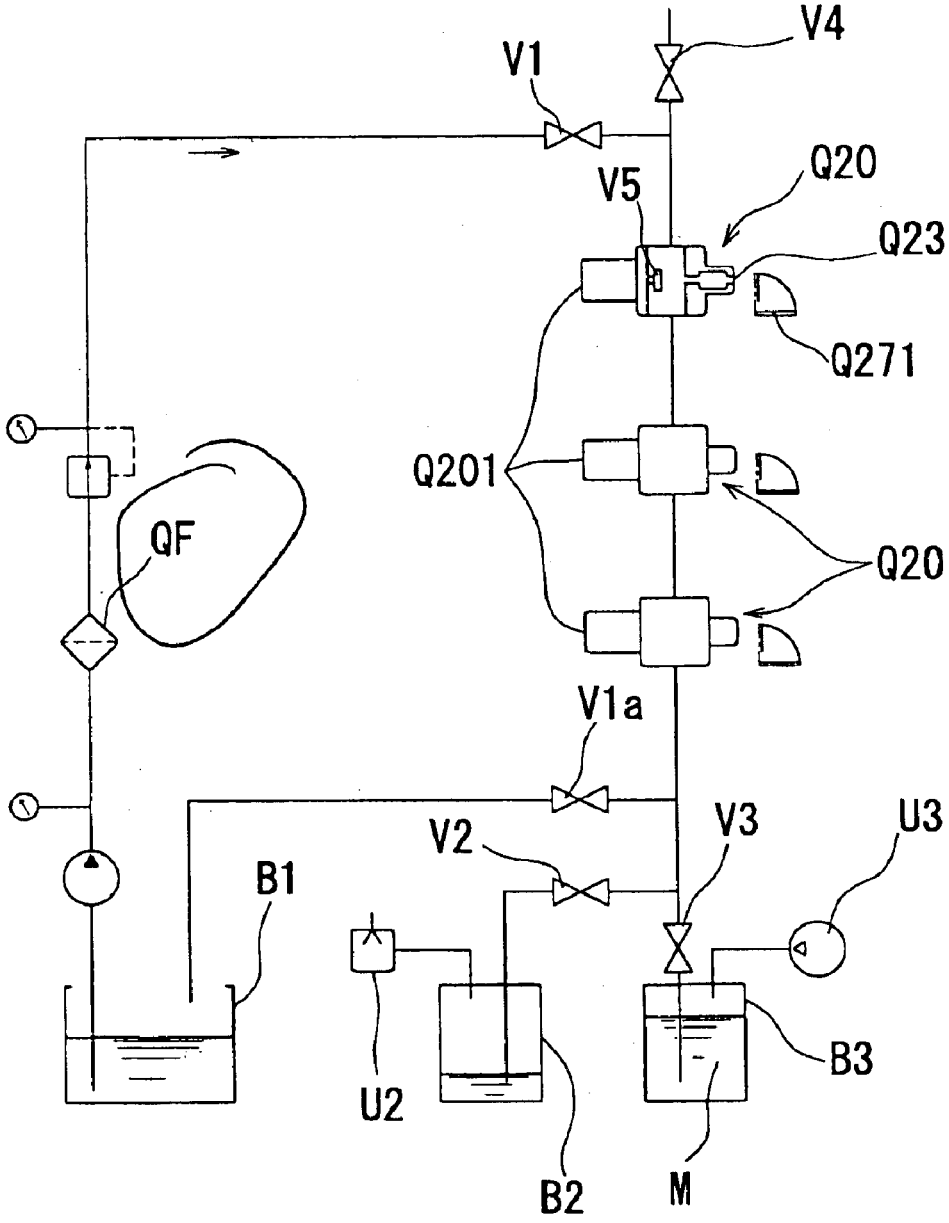
Fig.14 Prior Art 2
FIG. 14 is a schematic view of a spray-type dampening water supply apparatus according to the related art.

As shown in FIGS. 11 and 12, the spray-type dampening water supply apparatus A according to the present invention is comprised of a spray unit 100 disposed adjacent to and confronting a roller R of an offset printing press P, a compressed water supply unit B, a softener unit C, and a controller D. In these drawings, PR represents a printing plate; W, paper web; 106, an outlet; and E, the outside to where post-printing dampening water is drained. In the spray unit 100, a plurality of nozzles 10 (20, 30, 90) of FIGS. 3, 5 and 10 are mounted on a sprayer 101 at suitable distances.

The softener unit C softens raw water. The compressed water supply unit B prepares dampening water which is controlled so as to have a suitable conductivity, by processing the softened water with a treatment reducing surface tension of the softened water. The compressed water supply unit B then supplies the dampening water to the spray unit 100 via a filter F in which the dampening water is filtered.

The controller D issues operation instructions to the compressed water supply unit B and the sprayer 101, which is mounted in the spray unit 100, to activate a non-illustrated electromagnetic valve of the sprayer 101 to suitably spray dampening water from the nozzles 10 (20, 30, 90).

The nozzle 10, 20, 30, 90 of the spray unit 100 of the spray-type dampening water supply apparatus A according to the embodiments of the present invention will now described. FIGS. 1 through 3 show the nozzle 10 of the first embodiment according to the spray unit 100 of the spray-type dampening water supply apparatus A of the present invention, FIG. 4 shows the nozzle 20 of the second embodiment, FIG. 5 shows the nozzle 30 of the third embodiment, and FIG. 10 shows the nozzle 90 of the seventh embodiment. As shown in FIGS. 6 and 8, the nozzle 10 is fastened to one edge of the sprayer 101, which is attached to a support member 104 of the spray unit 100, by a nut 102, with a nozzle flange 15 held by the nut 102. The nozzles 20, 30, 90 are similar in fastening manner and operation to the nozzle 10.

A nozzle tip 12, 22, 32, 92 of the spray unit 100 of the spray-type dampening water supply apparatus A according to the present invention is a cone having a trapezoid cross section with an orifice 13, 23, 33, 93 as a peak in which a groove 14 having a suitable width and a suitable depth is formed. The orifice 13, 23, 33, 93 has a very small central oval hole communicating with a dampening water runner 103 leading to a nozzle body 11, 21, 31, 91.

The nozzle 10 of the first embodiment is fitted centrally in the nozzle body 11, with the orifice 13 of the nozzle tip 12 projecting from nozzle end surface 16. The nozzle body 11 has a crisscross guide surface 1 slanting from a base portion of the nozzle tip 12. The guide surface 1 guides airflow H, occurring with the spraying of the dampening water from the orifice 13, obliquely upwardly, and serves to wash away possible residual dampening water tending to stay around the nozzle tip 12.

The guide surface 1 is defined by a plurality of grooves 17 slanting from the nozzle flange 15, or the vicinity thereof, of the nozzle body 11 toward the nozzle tip 12, namely, from the upstream outer edge of the nozzle body 11 toward the downstream central orifice 13. In the first embodiment, the plural grooves 17 are composed of four grooves extend from the central orifice 13 outwardly in a crisscross formation as viewed in plan view. Each groove 17 is generally U-shaped in cross section and has a thus curved bottom surface 18. The width, depth and tilt of the groove 17 may be determined as appropriate.

The groove 17 defining the guide surface 1 may be a composite form of two or more grooves and may have a V-shaped cross-sectional shape or any other shape, provided that it does not make airflow H turbulent.

FIG. 10 is a partial cross-sectional view of the nozzle 90 having a guide surface 9 according to the seventh embodiment. The nozzle 90 is comprised of a nozzle tip 92 and a nozzle body 91, the nozzle tip 92 being disposed in a hole 96*a* opened in a central part of the nozzle end surface 96. In the seventh embodiment, the guide surface 9 is defined by the inside wall surfaces of inclined through-holes 97 slanting from a nozzle flange 95 of the nozzle body 91, toward the nozzle tip 92. The inclined holes 97 are composed of four inclined holes 97 slanting from the central orifice 93 outwardly in four directions. Each inclined hole 97 is circular or oval in cross section and has a thus curved inside wall surface. The width, depth and tilt of the inclined holes 97 may be determined as appropriate.

The nozzle 20 of the spray unit 100 of the spray-type dampening water supply apparatus A according to the second embodiment of the present invention will now be described.

As shown in FIG. 4, the nozzle 20 is comprised of a trapezoid pyramid nozzle body 21, and a conical nozzle tip 22 fitted in the flat peak surface of the trapezoid pyramid nozzle body 21, the nozzle tip 22 having a central orifice 23. The nozzle tip 22 is similar in construction and operation to the nozzle tip 12 of the first embodiment. The nozzle body 21 has a trapezoid pyramid guide surface 2. The guide surface 2 guides airflow H occurring with the spraying of dampening water from the orifice 23 and serves to wash away possible residual dampening water tending to stay around the nozzle tip 22.

The trapezoid pyramid guide surface 2 is composed of four slanted surfaces 27 slanting from the nozzle flange 25 of the nozzle body 21 toward the nozzle tip 22, namely, from the outer peripheral edge upstream of the nozzle body 21 toward the central orifice 23 downstream of the nozzle body 21 at a suitable angle. Alternatively, the guide surface 2 may be defined by a polygonal inclined surface 27 having three (triangular pyramid), five (pentagonal pyramid) or more slanted side surfaces. As other alternatives, the guide surface 2 may be a composite surface of two or more different curved surfaces rather than flat surfaces, or a hybrid surface composed of curved and flat surfaces.

The nozzle 30 of the spray unit 100 of the spray-type dampening water supply apparatus A according to the third embodiment will now be described. As shown in FIG. 5, the nozzle 30 is comprised of a generally conical nozzle body 31, and a generally conical nozzle tip 32 fitted in the center of the flat peak surface of the conical nozzle body 31, the nozzle tip 32 having an orifice 33. The nozzle tip 32 is similar in construction and operation to the nozzle tip 32 of the first embodiment. The guide surface 3 guides airflow H occurring with the spraying of dampening water from the orifice 33 and serves to wash away possible residual dampening water tending to stay around the nozzle tip 32.

The guide surface 3 is a generally conical surface 37 slanting from a nozzle flange 35 of the nozzle body 31 toward the nozzle tip 32, namely, from the outer peripheral edge upstream of the nozzle body 31 toward the central orifice 33 downstream of the nozzle body 31 at a suitable angle.

The bottom surface of each of the grooves 17 defining the guide surface 1 according to the first embodiment, each of the slanted surfaces 27 defining the guide surface 2 according to the second embodiment, the conical surface 37 defining the guide surface 3 according to the third embodiment, and the slanted surface of each of the slant holes 97 defining the guide surface 9 according to seventh embodiment may be a concave surface defined by a part of a hyperboloid of one sheet (Mathematics Pocket Dictionary, published Oct. 20, 1980 by Kyoritsu Publishing Inc., Page 17), which is concave-shaped or a convex surface bulging like part of a shell. That is, each of these slanted surfaces gradually varies toward the corresponding nozzle tip 12, 22, 32, 92 having the orifice 13, 23, 33, 93.

The spray unit 100 of the spray-type dampening water supply apparatus A according to the fourth embodiment of the present invention includes a partition 40 having apertures 41, disposed in front of and in alignment with each of the orifices 13 of the nozzle tips 12 of the nozzles 10 according to the first embodiment, as shown in FIG. 6. Each nozzle 10 is fastened to one end of the sprayer 101, which is attached to a support member 104 of the spray unit 100, by a nut 102 with the nozzle flange 15 held thereby.

The partition 40 is disposed with the aperture 41 opening so as not to hinder mist flow spouted from the orifice 13, touching or close to a part or whole of the nozzle end surface 16. Around the aperture 41, a hood 42 is disposed to guide the mist flow. The partition 40 is attached at opposite side edges 43, 43 to the respective side walls 105, 105 of the spray unit 100, separating a nozzle-body-side space 81 in which the nozzle body 11 is located, and a roller-side space 81*a* in which dampening water is sprayed to the roller R, except the aperture 41. The roller-side space 81*a* is also called the spraying space. When dampening water is sprayed from the orifice 13, rapid airflow H occurring with this spraying flows from the nozzle-body-side space 81 into the spraying space 81*a* via the aperture 41 as it is guided chiefly by the grooves 18, which define the guide surface 1, and the hood 42.

The spray unit 100 of the spray-type dampening water supply apparatus A according to the fifth embodiment of the present invention includes a partition 50 having an aperture 51 disposed in front of and in axial alignment with the orifice 33 of the nozzle tip 32 of the nozzle 30 according to third embodiment, as shown in FIG. 7.

The partition 50 is disposed with the aperture 51 opening so as not to hinder mist flow spouted from the orifice 33, and a hood 52 disposed around the aperture 51 and having a surface spaced a suitable distance from the conical surface 37 of the nozzle body 31. The partition 50, like the partition 40 of the fourth embodiment, is attached at opposite side edges to the respective side walls 105, 105 of the spray unit 100, separating a nozzle-body-side space 82 in which the nozzle body 31 is located, and a roller-side space 82*a* in which dampening water is sprayed to the roller R, except the aperture 51. When dampening water is sprayed from the orifice 33, rapid airflow H occurring with this spraying flows from the nozzle-body-side space 82 into the spraying space 82*a* via the aperture 51, traveling through the space between the conical surface 37, i.e. the guide surface 3, and the hood 52 as it is guided chiefly by the conic surface 37.

The spray unit 100 of the spray-type dampening water supply apparatus A according to the eighth embodiment of the present invention has a non-illustrated partition of the nozzle 20 (FIG. 4) of the second embodiment. In the spray unit 100 of the eighth embodiment, the nozzle 20 (second embodiment) is substituted for the nozzle 30 (third embodiment) used in the spray unit 100 of the fifth embodiment. This partition itself is similar in construction and operation to the partition 50 used in the spray unit 100 of the fifth embodiment.

The spray unit 100 of the spray-type dampening water supply apparatus A according to sixth embodiment includes a partition 60 disposed as shown in FIG. 8. The partition 60 has an aperture 61 in front of the nozzle 10 of the first embodiment in axial alignment with the orifice 13 of the nozzle tip 12, and opening and closing means 70 in the form of a shutter 71 capable of opening and closing the aperture 61. The nozzle 10 is fastened to one end of the sprayer 101 attached to a support member 104 of the spray unit 100, by a nut 102 with a nozzle flange 15 held thereby.

The partition 60 is disposed with the aperture 61 opening so as not to hinder mist flow spouted from the orifice 13, touching or close to a part or whole of the nozzle end surface 16. Around the aperture 61, a hood 62 is disposed to guide the mist flow. The partition 60 is attached at side edges 63, 63 to the respective side walls 105, 105 of the spray unit 100, separating a nozzle-body-side space 83 in which the nozzle body 11 is located, and a roller-side space 83*a* in which dampening water is sprayed to the roller R, except the aperture 61. When dampening water is sprayed from the orifice 13, rapid airflow H occurring with this spraying flows from the nozzle-body-side space 83 into the spraying space 83*a* via the aperture 61 as it is guided chiefly by the grooves 17, which define the guide surface 1, and then the hood 62.

The opening and closing means 70 is mounted on the partition 60 and is comprised of a shutter 71 capable of opening and closing the aperture 61, and a hydraulic cylinder 72 for driving the shutter 71, as shown in FIGS. 8 and 9. The hydraulic cylinder 72 is angularly movably supported at one end on a bracket 73 by a pin 73*b*, the bracket 73 being fastened to the partition 60 by a bolt 73*a*. The hydraulic cylinder 72 is connected at the other end to one end of an arm 75, which is integrally movable with the shutter 71, by a pin 74*a* with a joint 74 attached to a distal end of a piston rod 72*a*. The other end of the arm 75 is attached to one end of a shaft 76 angularly movably supported by a bearing 66 mounted on the partition 60, and one end of the shutter 71 is attached to the other end of the shaft 76.

The other end of the shutter 71 has such a wide blade as to open and close the aperture 61, like a fan as viewed in plan view. The shutter 71 is angularly movable about the shaft 76 with one surface touching the edge 64 of the aperture 61. As the shutter 71 is angularly moved about the shaft 76, a free end edge or blade 71*a* of the shutter 71 draws an arc. Along the arc drawn by the blade 71*a* of the shutter 71, a guide 65 extends on a portion of the aperture edge 64. The guide 65 serves to prevent the shutter 71 from being moved downstream, i.e. in the spraying direction, and also serves to guide the blade 71*a* of the shutter 71 as the shutter 71 is angularly moved.

When the piston rod 72*a* of the hydraulic cylinder 72 is expanded, the arm 75 is angularly moved about the shaft 76 so that the shutter 71 fixedly mounted on the shaft 76 is angularly moved so as to close the aperture 61. When the piston rod 72*a* of the hydraulic cylinder 72 is shrunk, the arm 75 is angularly moved in the reverse direction so that the shutter 71 is angularly moved so as to open the aperture 61.

The shutters 71 are provided on each of the apertures 61 corresponding to the plural nozzles 10 and are driven by the associated hydraulic cylinders 72. As a non-illustrated ninth embodiment, the shutters 71 provided on the nozzles 10 respectively may be driven by one or more shared hydraulic cylinders 72 with all or some of adjacent arms 75 being connected together.

The outer peripheral surfaces of the nozzle bodies 11, 21, 31, 91 and of the nozzle tips 12, 22, 32, 92 according to the foregoing embodiments of the present invention may be processed with a surface treatment so as to prevent adhesion of dirt and foreign matter. This surface treatment is exemplified by a smoothening process to reduce the surface roughness, and a coating process to cover the surface with a coating of a water-repellent or oil-repellent substance. Since the nozzles are made ordinarily of stainless steel, the smoothing treatment is preferably an electromagnetic grinding process, and the water- or oil-repellent coating process is preferably a fluoric resin or a silicone resin.

The surfaces of the partitions 40, 50, 60 of the fourth through sixth, eighth and ninth embodiments and the surfaces of the shutters 71 of the opening and closing means 70 of the sixth and ninth embodiments may also be processed with the same surface treatment, so that the inside of the spray unit 100 can be less contaminated with dirt, facilitating the cleaning operation.

The operation of the spray-type dampening water supply apparatus A according to the foregoing embodiments of the present invention will now be described. For the overall or general operation of the spray-type dampening water supply apparatus A, as shown in FIGS. 11 and 12, when the controller D is operated, the compression water supply unit B is activated to supply dampening water to the spray unit 100. When the printer P starts printing, the non-illustrated electromagnetic valves incorporated in the respective spray units 101 of the spray unit 100 is activated in accordance with an instruction from the controller D so that the compressed dampening water is defecated by the filter F and then supplied to the individual spray units 101. The dampening water supplied to the individual spray units 101 is sprayed to the confronting peripheral surface of the roller R from the respective orifices 13 of the corresponding nozzles 10 (the respective orifices 23 of the corresponding nozzles 20, the respective orifices 33 of the corresponding nozzles 30, the respective orifices 93 of the corresponding nozzles 90). As a result, because the nozzles 10, 20, 30, 90 of each of the foregoing embodiments have the respective guide surfaces 1, 2, 3, 9, air around each nozzle body 11, 21, 31, 91 is attracted to be blown up toward the nozzle tip 12, 22, 32, 92 as rapid airflow H and also to blow away the residual dampening water tending to stay around the nozzle tip 10, 22, 32, 92. This action of rapid airflow H prevents occurrences of retaining of dampening water, adhesion of dirt to and around the nozzle tips 10, 20, 30, 90, and deposition of dirt due to the vaporizing of residual water, and it is possible to maintain adequate spraying performance for a long duration, thus facilitating maintenance of the nozzles 10, 20, 30, 90.

Excessive dampening water that has been sprayed but failed to be transferred to the circumferential surface of the roller R, and other foreign matter, are collected inside the spray unit 100 and then discharged to the outside E via the outlet 106. Accordingly the spray-type dampening water supply apparatus A of the present invention guarantees good performance without any risk of making the construction complex.

Following is detailed description on the operations of the guide surfaces 1, 2, 3, 9, of the partitions 40, 50, 60 and of the opening and closing means 70 in the individual spray-type dampening water supply apparatuses A of the foregoing embodiments of the present invention.

The guide surface 1 of the nozzle 10 in the first embodiment guides airflow to the four grooves 17 engraved in the nozzle body 11 in four different directions about the nozzle tip 12, and also guides the residual dampening water tending to stay around the nozzle tip, so as to wash away it. Air attracted around the nozzle body 11 with the spraying of dampening water from the orifice 13 is collected in the four grooves 17 and is blown up, together with dampening water mist, toward the nozzle tip 12 from the four radial grooves 17 as rapid airflow H without causing any turbulent eddies. By the action of this rapid airflow H, it is possible to prevent any adhesion of foreign matter to the nozzle tip 12 during the spraying and any occurrence of retention of residual dampening water, thereby causing no deposition of dirt when the residual water vaporizes. The transverse cross section of the groove 17 defining the guide surface 1 may be V-shaped with the same result and operation. Even with the guide surface 9 defined by the inside wall surface of the inclined hole 97 as of the seventh embodiment, partly because air is attracted from the slant hole 97 as the air pressure is reduced around the orifice 93 due to the spraying and partly because of retention of residual water, the same result and operation can be achieved.

The guide surface 2 of the nozzle 20 according to the second embodiment guides air around the nozzle body 21 along the trapezoid pyramid slanted surface 27 when dampening water is sprayed from the orifice 23, and also guides residual dampening water tending to stay around the nozzle tip 22, so that the residual dampening water flows off the slanted surface 27. It is therefore possible to blow up air around the nozzle tip as rapid airflow H upon spraying, without the occurrence of any disturbing eddies toward the nozzle tip. This prevents adhesion of foreign matter to the nozzle tip 22 during the spraying, and occurrence of retention of residual water on the nozzle tip and hence deposition of dirt when the residual water vapors.

The guide surface 3 of the nozzle 30 according to the third embodiment guides air around the nozzle body 31 along the conical surface 37 without turbulence when dampening water is sprayed from the orifice 23, and also guides residual dampening water tending to stay around the nozzle tip 32, so that the residual dampening water flows off the slanted surface 37. It is therefore possible to blow air up around the nozzle tip as rapid airflow H upon spraying, without the occurrence of any disturbing eddies toward the nozzle tip. This prevents adhesion of foreign matter to the nozzle tip 32 during the spraying, occurrence of retention of residual water on the nozzle tip and hence deposition of dirt when the residual water vaporizes.

The partition 40 of the spray unit 100 according to the fourth embodiment is disposed downstream of the nozzle 10 in confronting relation to the nozzle tip 12 of the first embodiment, with the aperture 41 defined by the hood 42 and confronting the orifice 13 of the nozzle 10. The aperture 41 communicates to the groove 17 defining the guide surface 1 of the nozzle body 11, and the partition 40 equipped with the hood 42 serves to prevent air in the spraying space 81*a* from being attracted toward the nozzle-body-side space 81 during the spraying.

Air attracted by the dampening water sprayed from the orifice 13 of the nozzle 10 in the nozzle-body-side space 81 is supplied from the nozzle-body-side space 81 as clean air free of either ink mist or paper powder. This clean air, together with dampening water mist, is blown up into the spraying space 81*a* as rapid airflow H so that adhesion of foreign matter to the nozzle tip 12 is prevented by the action of this rapid airflow H.

The partition 50 of the spray unit 100 according to the fifth embodiment is disposed downstream of the nozzle 30 in confronting relation to the nozzle tip 32 of the first embodiment, with the aperture 51 defined by the hood 52 and confronting the orifice 13 of the nozzle 30. The hood 52 is disposed around the aperture 51 and is spaced a suitable distance from the conic surface 37, i.e. the guide surface 3, of the nozzle body 31, and the partition 50 equipped with the hood 52 serves to prevent air of the spraying space 82*a* from being attracted into the nozzle-body-side space 81 during the spraying.

Air attracted by the dampening water sprayed from the orifice 13 of the nozzle 10 in the nozzle-body-side space 82 is supplied from the nozzle-body-side space 82 as clean air free of either ink mist or paper powder. This clean air, together with dampening water mist, is blown up into the spraying space 81*a* as rapid airflow H so that adhesion of foreign matter to the nozzle tip 12 is prevented by the action of this rapid airflow H.

The opening and closing means 70 provided on the partition 60 mounted in the nozzle 10 of the spray unit 100 according to the sixth embodiment activates the hydraulic cylinder 72 to angularly move the shutter 71, thereby opening or closing the aperture 61 in the partition 60, as shown in FIGS. 8 and 9.

When the printer P is in operation, the piston rod 72*a* of the hydraulic cylinder 72 assumes an expanded posture so that the shutter 71 closes the aperture 61. A closed space 67 is defined between the aperture 61 closed by the shutter 71 and the nozzle tip 12.

When the printer P is in operation and the spray unit 100 is ready to start spraying, the piston rod 72*a* of the hydraulic cylinder 72 assumes a shrunken posture so that the shutter 71 opens the aperture 61 to allow spraying of dampening water through the aperture 61. When the printer P starts printing with the spray unit 100 in operation, dampening water sprayed from the orifice 13 attracts air around the nozzle body 11 to guide and is blown up toward the nozzle tip 12 as rapid airflow H so that adhesion of foreign matter to the nozzle tip 12 during the spraying is prevented by the action of this airflow. When the printing is terminated, the piston rod 72*a* of the hydraulic cylinder 72 is expanded so that the shutter 71 closes the aperture 61.

Assuming that the spray unit 100 is operated with the shutter 71 assuming an aperture-closing posture, dampening water sprayed from the orifice 13 strikes the shutter 71 on the side confronting the orifice 13 to become a torrent of liquid in the closed space 67 so that the inside of the aperture 61, the nozzle tip 12 and nozzle body 11 are washed out by force by the action of this torrent of liquid. Also, because retention of residual dampening water does not occur around the nozzle tip 12, dirt is not deposited there when the residual dampening water vaporizes. The dampening water sprayed for washing the nozzle 10 is collected and then discharged to the outside E from the outlet 106 of the spray unit 100. This washing with the sprayed dampening water takes place usually upon termination of printing while the nozzle-body-side space 83 is clear. The washing period of time may be determined as desired.

The outer peripheral surfaces of the nozzles 10, 20, 30, 90 according to the foregoing embodiments of the present invention may be processed with a surface treatment such as to prevent adhesion of dirt and foreign matter. For example, the outer peripheral surfaces of the nozzles 10, 20, 30, 90 processed with a smoothing treatment is free of rough edges and burrs so that either catching of dirt by or adhesion of foreign matter to the nozzle surfaces is likely to occur. With respect to the outer peripheral surfaces of the nozzles 10, 20, 30, 90 coated with a water- and oil-repellent substance, adhesion of water and oil, namely, dirt is very small so that either adhering or accumulation of dirt is very unlikely to occur.

As described above, by the action of each of the guide surface, the partition, the opening and closing means, and the adhesion-proof surface treatment according to the foregoing embodiment of the present invention, or by any combination of them, it is possible to carry out prevention of adhesion of foreign matter to the nozzles 10, 20, 30, 90 and cleaning of the nozzles 10, 20, 30, 90 with maximum efficiency so that the nozzles 10, 20, 30, 90 can always be kept clean.

According to the present invention, the following advantageous results can be guaranteed.

Because airflow is blown up by the guide surface, it is possible to prevent adhesion and accumulation of dirt to and in the nozzle during the spraying, which would have occurred in the conventional spray-type dampening water supply apparatus. Also, because residual water flows off the guide surface without staying there, it is possible to prevent deposition of dirt when the residual water vaporizes, thus facilitating cleaning and maintenance of the nozzles.

Further, the nozzles are prevented from being contaminated with dirt, maintenance of the dampening water supply apparatus is facilitated, and stabilized spraying of dampening water is achieved for a long duration. It is therefore possible to optimize the printing state and also to guarantee excellent printing quality. Furthermore, according to the present invention, because no complicated mechanism or additional parts are necessary to secure adequate dirt-resistance, it is possible to reduce the cost of production to a minimum.

According to an embodiment of the present invention, partly because the spray is provided with a nozzle assembly of a plurality of nozzles for spraying the dampening water, each nozzle having a guide surface slanting from an upstream outer peripheral edge toward a downstream central orifice, and partly because the spray is provided with a partition disposed downstream of the nozzle assembly and having a plurality of apertures confronting the respective nozzles, it is possible to isolate the nozzles confronting the apertures from the spraying space in which ink mist is floating, by the partition so that the action of the guide surface can become more effective. It is therefore possible to keep the nozzle free of dirt for a long duration.

According to an embodiment of the present invention, partly because the spray is provided with a nozzle assembly of a plurality of nozzles for spraying the dampening water, each nozzle having a guide surface slanting from an upstream outer peripheral edge toward a downstream central orifice, partly because a partition is disposed downstream of the nozzle assembly and has a plurality of apertures confronting the respective nozzles, and partly because means are provided for opening and closing the apertures of the partition, it is possible to isolate the nozzles, as closed in the nozzle-body-side space, and carry out cleaning of the isolated nozzles, when the nozzles are not used. It is therefore possible to always keep the nozzles in a clean condition and to supply dampening water in stabilized mist to the roller for a long duration. Further, because it is unnecessary to adjust the dampening water spraying status, cleaning of the nozzles can be carried out with less labor, and the condition of the dampening water supply apparatus can be maintained with maximum ease.

According to an embodiment of the present invention, because each nozzle is treated at at least a portion surrounding and adjacent to the orifice so as to prevent adhesion of any foreign matter to the portion, it is possible to neutralize the adhesion of dirt and foreign matter to the circumference of the orifice and the guide surface as well, thus preventing adhesion and accumulation of dirt with improved efficiency.

What is claimed is:

1. A spray-type apparatus for supplying dampening water to a peripheral surface of a roller extending to a printing plate of an offset printing press, having a spray unit comprising:

a nozzle assembly of a plurality of nozzles for spraying the dampening water, each of said nozzles having a guide surface slanting from an upstream outer peripheral edge toward a downstream central orifice;

a partition disposed downstream of said nozzle assembly and having a plurality of apertures confronting the respective nozzles; and means for opening and closing said apertures of said partition.

2. The spray-type dampening water supply apparatus according to claim 1, wherein said guide surface is conical.

3. The spray-type dampening water supply apparatus according to claim 1, wherein said guide surface is pyramidal.

4. The spray-type dampening water supply apparatus according to claim 1, wherein said nozzles have a through-hole extending from said outer peripheral edge toward said orifice and said guide surface is defined by an inside wall surface of said through-hole.

5. The spray-type apparatus according to any one of claim 2, claim 3, claim 4, or claim 1, wherein each of said nozzles is treated at at least a-portion surrounding and adjacent to said orifice so as to prevent adhesion of any foreign matter to said portion.

6. The dampening water supplying spray apparatus according to any one of claim 1 wherein said guide surface is composed of a plurality of segmented guide surfaces.

7. The spray-type dampening water supply apparatus according to any one of claim 1, wherein said plural segmental guide surfaces are arranged equidistantly about said orifice.

8. A spray-type dampening water supply apparatus having a nozzle for spraying dampening water to a peripheral surface of a roller extending to a printing plate of an offset printing press, wherein said nozzle has a guide surface slanting from an upstream outer peripheral edge toward a downstream central orifice, wherein said nozzle has a groove and said guide surface is defined by an inside wall surface of said groove, and wherein said groove has a U-shaped transverse cross section.

9. The spray-type dampening water supply apparatus according to claim 8, wherein the nozzle is treated at at least a portion surrounding and adjacent to said orifice so as to prevent adhesion of any foreign matter to said portion.

* * * * *